United States Patent [19]

Fisch et al.

[11] Patent Number: 4,717,500

[45] Date of Patent: Jan. 5, 1988

[54] GETTER DEVICE FOR FRIT SEALED PICTURE TUBES

[75] Inventors: Herbert A. Fisch, Beachwood; Edward M. Palsha, Lakewood; Sandra L. Skotko, North Royalton, all of Ohio

[73] Assignee: Union Carbide Corporation, Danbury, Conn.

[21] Appl. No.: 802,328

[22] Filed: Nov. 27, 1985

[51] Int. Cl.[4] ..... H01J 7/18

[52] U.S. Cl. ..... 252/181.4; 252/181.7; 313/481; 313/561

[58] Field of Search ..... 252/181.4, 181.7; 313/481, 561

[56] References Cited

U.S. PATENT DOCUMENTS

| | | | |
|---|---|---|---|
| 3,973,816 | 8/1976 | Van Bakel et al. | 252/181.4 X |
| 4,029,987 | 6/1977 | Zucchinelli | 313/481 X |
| 4,045,367 | 8/1977 | Bakel et al. | 252/181.4 |
| 4,077,899 | 3/1978 | van Gils | 252/181.4 |
| 4,127,361 | 11/1978 | Hellier et al. | 252/181.4 X |
| 4,225,805 | 7/1980 | Smithgall et al. | 313/481 |
| 4,342,662 | 8/1982 | Kimura et al. | 252/181.4 |
| 4,481,441 | 11/1984 | van Gils | 313/481 |
| 4,486,686 | 12/1984 | della Porta | 313/481 |
| 4,504,765 | 3/1985 | della Porta | 313/481 |
| 4,642,516 | 2/1987 | Ward et al. | 313/481 |

FOREIGN PATENT DOCUMENTS

| | | | |
|---|---|---|---|
| 1372823 | 11/1974 | United Kingdom | 252/181.4 |

*Primary Examiner*—Matthew A. Thexton

*Attorney, Agent, or Firm*—C. F. O'Brien

[57] ABSTRACT

Getter device containing a barium-aluminum alloy powder and a boron-containing, and chromium-containing nickel base alloy powder.

6 Claims, 6 Drawing Figures

FIG. 3a
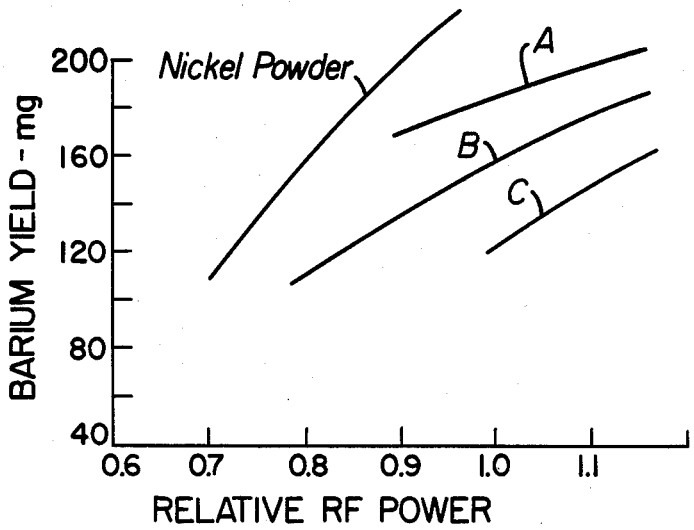
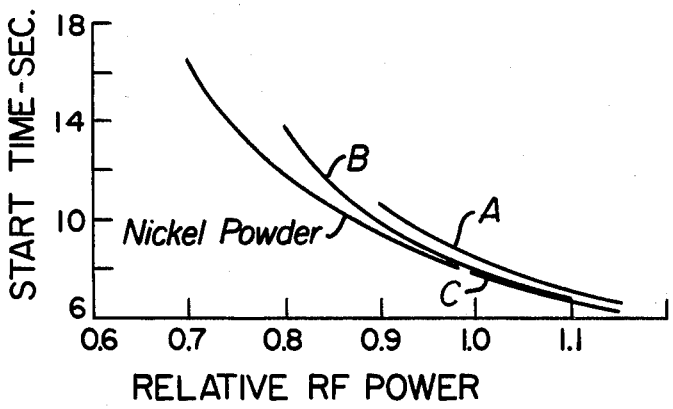
FIG. 3b

FIG. 3c
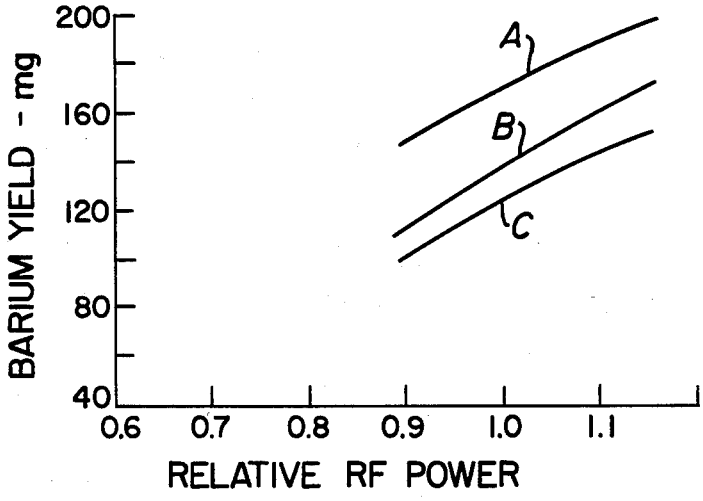
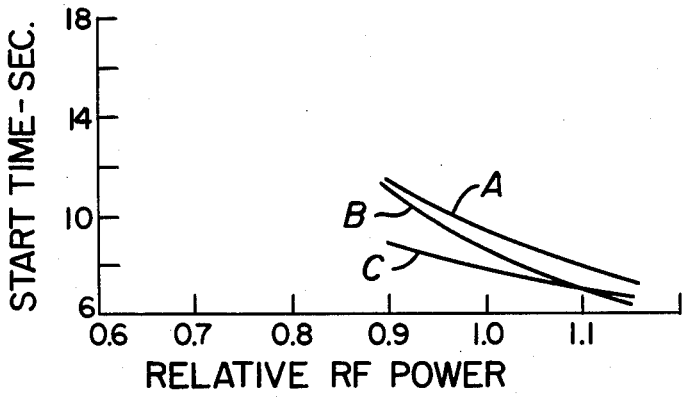
FIG. 3d

GETTER DEVICE FOR FRIT SEALED PICTURE TUBES

The present invention relates to a getter device having a boron-containing and chromium-containing nickel base alloy powder blended with a barium-aluminum powder. More particularly the present invention relates to a getter device which is not subject to ejection of particles of getter material from the getter device during flashing.

Conventional barium getters are typically in the form of an open annular metal getter container and utilize as the getter material a blended powder mixture of barium-aluminum alloy having a composition approximately $BaAl_4$ (e.g. about 53% by weight Ba and 47% weight Al) and high purity nickel; the barium-aluminum alloy and nickel each being present in about equal parts by weight in the blended mixture. The getter material is pressed into the metal getter container and the getter device is mounted inside the picture tube. In present picture tube manufacture the getter is mounted in the picture tube after the "frit bake" procedure. New picture tube processing techniques are moving toward mounting the getter in the tube prior to "frit baking" for functional as well as economic reasons. During the manufacture of TV picture tubes, the panel and funnel are sealed together using a conventional frit glass in paste form. This frit sealing is done in air by heating at temperatures of 350°–450° C. for 1 to 2 hours("frit bake").

After such exposure to the "frit bake", barium yield from a flashed getter is reduced. A more serious consequence of frit sealing temperature exposure in air is that some nickel oxide is formed in the high purity nickel powder component of the getter material. Upon flashing to release barium from the getter this nickel oxide reacts violently with barium aluminum alloy, ejecting particles of getter material. These particles may fall onto the electrode structure causing electrical faults and also block small apertures in the shadow mask of the picture tube resulting in a defective picture. The foregoing problems have been addressed in the prior art, for example, by placing a protective coating on the exposed surface of the getter material in the getter device and by efforts to lessen oxidation of the high purity nickel component under frit sealing temperature conditions.

Examples of protective coatings include the use of organic binder compounds (United Kingdom Pat. No. 1,372,823, U.S. Pat. No. 4,127,361), inorganic film dip coatings of boron compounds, which may be mixed with a silicon oxide (U.S. Pat. No. 4,342,662) and fusible metallic covers attached to the getter cup (U.S. Pat. No. 4,224,805).

Typically nickel powder used in conventional getters has a Fisher Subsieve size of 3–7 microns, a specific surface area of 0.34–0.44 square meters per gram and an apparent density of 1.8–2.7 gm/cc. This small particle size and high surface area results in a high reactivity when heated with barium aluminum alloy vaporizing a high percentage of the total available barium in a short time consistent with modern mass production techniques. However, when the fine nickel powder with its high surface area is subjected to "frit bake", it leads to the formation of sufficient nickel oxide to produce violent reactivity and subsequent particle ejection from the getter. U.S. Pat. No. 4,077,899 addresses this reactivity problem by increasing the nickel particle size diameter up to 80 microns (20–65 micron range being specified as particularly favorable) with a specific surface area smaller than 0.15 $m^2/gm$ together with an average barium-aluminum particle size less than 125 micron. The foregoing prior art techniques have not been completely satisfactory and the problem of particle ejection during "flashing" remains to be satisfactorily solved.

It is an object of the present invention to provide a relatively simple getter device which will avoid the problem of ejection of particles from the getter device during flashing while providing adequate barium yield and avoiding the use of materials such as organic compounds which could contaminate the picture tube and degrade picture tube performance.

Other objects will be apparent from the following description and claims taken in conjunction with the drawing wherein;

The present invention is a getter device comprising a metal getter material filled in said getter container comprising a barium-aluminum alloy and a nickel base powder, said nickel base powder consisting essentially of an alloy of from 0.05 to 4% boron, 0.25 to 18.5% chromium, up to 5% iron, up to 5% silicon balance substantially all nickel.

Figure 1:
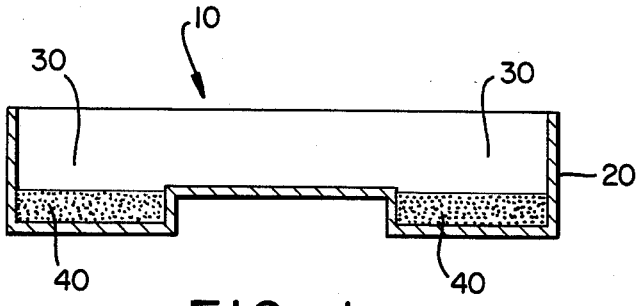
FIG. 1 shows an elevational sectional view of a conventional getter device.

With reference to the drawing, a getter device is shown generally at 10 in FIG. 1 comprising a conventional metal container 20 having an annular groove 30 which contains getter material 40. Getter material 40, in accordance with the present invention is a blended mixture of particulated barium-aluminum alloy (suitably sized 65 mesh and finer) with nickel base alloy powder (about 1:1 ratio by weight) consisting essentially of a nickel base alloy containing 0.05 to 4% by weight boron, 0.25% to 18.5% by weight chromium (preferably 5 to 18%) up to 5% by weight iron (preferably 1.5 to 2.5%) and up to 5% by weight silicon (preferably 2 to 4%); a preferred specific nickel base alloy composite in accordance with the present invention is about 2% boron, 10.5% chromium, 2% iron, 3.25% silicon, balance nickel. The form of the nickel base alloy powder is suitably spherical or ellipsoidal particles and agglomerates thereof sized about 35 mesh and finer with a minimum size of about 20 microns; the preferred sizing is 100 mesh and finer with a minimum size of 140 mesh (mesh sizes are United States standard screen series).

In the present invention it has been found that the presence of boron in the nickel base alloy will effectively suppress ejection of particles from the "frit-baked" getter during subsequent flashing provided that chromium is also present in the alloy to moderate the activity of the boron during flashing. At boron levels below 0.05%, the suppression of particle ejection is uncertain; at boron levels above about 4%, there is the possibility of particle ejection during flashing due to localized over-heating of the getter material. A preferred relation between the boron and chromium is that the amount by weight of chromium in the alloy be about 4 to 6 times the amount of boron.

Figure 2:
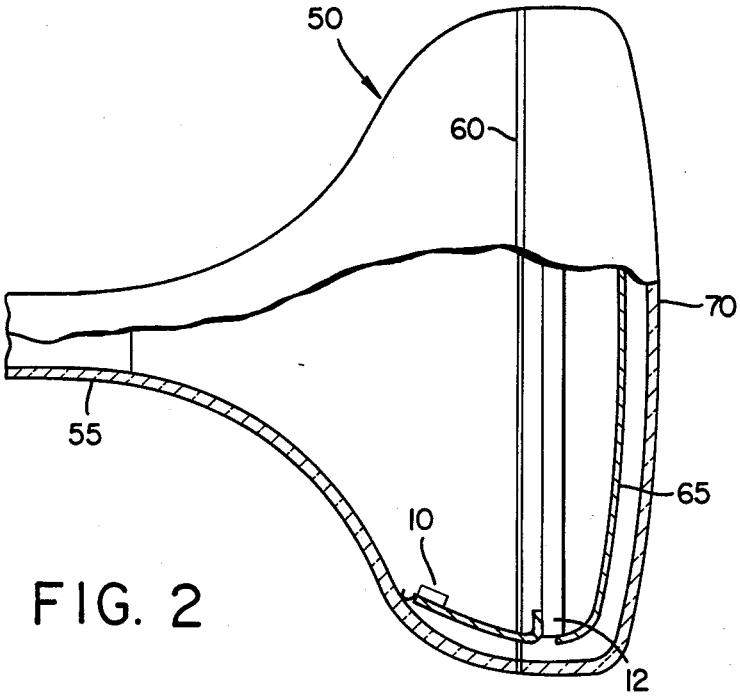
FIG. 2 shows the getter device of FIG. 1 installed in a picture tube and FIGS. 3(*a*)–(*d*) show graphs which illustrate barium yield and start time for different getter materials.

With reference to FIG. 2 the getter device 10 of the present invention is positioned in a picture tube indicated at 50 by being mounted on shadow mask frame 12 which supports mask 65. The funnel portion 55 of picture tube 50 has been sealed at 60 to the panel portion 70; the seal is accomplished by using a conventional glass frit material which is heated in place, in air, typically at 350°–450° C. for 1 to 2 hours, thus exposing the getter device 10 and the contained getter material 40 to the same conditions which ordinarily lead to the formation of nickel oxide in the getter material, with resultant ejection of solid particles of getter material from the getter into the picture tube during subsequent "flashing" of the getter. However, with the use of the boron-containing and chromium containing nickel base alloy of the present invention this undesirable result is avoided.

By way of example, annular getter devices comprising a stainless steel container formed from strip 0.007" thick were provided with getter material comprising barium-aluminum alloy powder and boron-containing and chromium-containing nickel based alloy powder in about 1:1 by weight ratio. The getter devices were heated in air in a simulated "frit bake" for about 1 hour at 450° C. and thereafter "flashed" in an ASTM type test bulb by means of an induction coil. With devices in accordance with the present invention, ejection of getter particles during flashing was avoided and adequate yields of barium were obtained. In test of similar getter devices (except that the nickel powder did not contain boron) particle ejection was experienced.

The following table illustrates advantages of the present invention in conjunction with FIGS. 3(*a*)–3(*d*). Samples B and C of the Table, in accordance with the present invention, were not subject to particle ejection and provided satisfactory barium yield and start time. Sample A, containing boron but no chromium, exhibited particle ejection and was unsatisfactory. FIGS. 3*a* and 3*b* show getter flashing parameters on getters not subjected to a frit bake cycle while FIGS. 3*c* and 3*d* show the same parameters after frit bake.

TABLE

| Powder Sample | "A" | "B" | "C" |
|---|---|---|---|
| Particle Mesh Size Range | 100/140 | 100/140 | 100/140 |
| Composition, Wt. Percent | | | |
| Ni | 93.96* | 83.12* | 76.45* |
| Fe | 1.4 | 1.85 | 4.0 |
| Cr | — | 9.75 | 12.1 |
| B | 1.7 | 1.9 | 2.8 |

TABLE-continued

| Powder Sample | "A" | "B" | "C" |
|---|---|---|---|
| Si | 2.9 | 3.3 | 4.1 |
| C | 0.04 | 0.08 | 0.55 |
| Size Distribution % | | | |
| +80 Mesh | | | |
| +100 | 6.6 | 4.7 | 4.9 |
| +120 | 46.3 | 44.5 | 45.6 |
| +140 | 43.0 | 41.4 | 47.5 |
| −140 | 2.1 | | 2.0 |
| +200 | | 8.2 | |
| −200 | | 1.2 | |
| Apparent Density g/cc | 3.33 | 3.05 | 3.53 |
| Specific Area $m^2/g$ | 0.108 | 0.16 | 0.41 |
| Particle Ejection | Yes | No | No |
| Barium Yield | Satisfactory | Satisfactory | Satisfactory |

*calculated by difference

What is claimed is:

1. A getter device comprising a metal getter container, a getter material filler in said getter container comprising a blended mixture of a particulated barium-aluminum alloy and a nickel base powder, said nickel base powder consisting essentially of an alloy containing boron and chromium in combination for suppressing particle ejection from the getter, said alloy composed of from about 0.05 to 4% boron, 0.25 to 18.5% chromium, up to 5% iron, up to 5% silicon, all by weight percents, and the balance nickel.

2. A getter device in accordance with claim 1 wherein said nickel alloy consists essentially of from about 0.05 to 4% boron, 2 to 18% chromium, up to 5% iron, up to 5% silicon, and the balance nickel.

3. A getter device in accordance with claim 1 or 2 wherein said alloy consists essentially of about 1.5 to 2.5% boron, 9.5 to 11.5% chromium, 1.5 to 2.5% iron, 2 to 4% silicon, balance substantially all nickel.

4. A getter device in accordance with claim 3 wherein said alloy consists essentially of about 2% boron, 10.5% chromium, 2% iron, 3.25% silicon, balance substantially all nickel.

5. A getter device in accordance with claim 1 wherein said nickel base powder is substantially all sized about 35 mesh and finer with a minimum size of about 20 microns.

6. A getter device in accordance with claim 1 wherein said nickel base powder is substantially all sized about 100 mesh and finer with a minimum size of 140 mesh.

* * * * *